United States Patent [19]

Samejima et al.

[11] Patent Number: 4,917,620

[45] Date of Patent: Apr. 17, 1990

[54] WATERPROOF ELECTRICAL CONNECTOR

[75] Inventors: Masakuni Samejima; Kiyohito Fukuda; Mitsuru Matsumoto, all of Haibara, Japan

[73] Assignee: Yazaki Corporation, Tokyo, Japan

[21] Appl. No.: 262,631

[22] Filed: Oct. 26, 1988

[30] Foreign Application Priority Data

Oct. 28, 1987 [JP] Japan ..... 62-163616[U]
Oct. 28, 1987 [JP] Japan ..... 62-163617[U]

[51] Int. Cl.[4] ..... H01R 13/52
[52] U.S. Cl. ..... 439/272; 439/271
[58] Field of Search ..... 439/271–283

[56] References Cited

U.S. PATENT DOCUMENTS 2,655,638 10/1953 Allen ..... 439/275
3,938,545 2/1976 Cairns et al. .
4,173,349 11/1979 Neale, III ..... 439/279
4,349,241 9/1982 Juris et al. ..... 439/281
4,556,226 12/1985 Ito .
4,611,872 9/1986 Ito et al. .
4,621,883 11/1986 Noguchi .

FOREIGN PATENT DOCUMENTS 1515748 4/1969 Fed. Rep. of Germany ..... 439/277
1314138 11/1962 France ..... 439/271

*Primary Examiner*—David Pirlot
*Attorney, Agent, or Firm*—Armstrong, Nikaido Marmelstein, Kubovcik & Murray

[57] ABSTRACT

A waterproof electrical connector. The waterproof electrical connector is comprised of a male connector housing and the female connector housing. The male connector housing has an annular enclosure around an outer periphery thereof to form an annular cavity therebetween. A seal ring is inserted into the annular cavity. The above-mentioned seal ring has a first section of smaller wall thickness to leave a space, when inserted into the cavity, forwardly opening and a second section of larger wall thickness extending rearwardly of said first section to resiliently press fit the annular enclosure, the end wall and the outer periphery. The female connector housing has a sleeve formed forwardly of an outer periphery thereof and adapted to be inserted into said space. Due to the existence of the second section of larger wall thickness in the seal ring, the turning over thereof which takes place at the time of engaging and disengaging the prior art waterproof connector is prevented.

2 Claims, 4 Drawing Sheets

WATERPROOF ELECTRICAL CONNECTOR

BACKGROUND OF THE INVENTION

The present invention relates to the improvement of a waterproof electrical connector and more particularly to the improvement of a seal ring employed in a waterproof electrical connector.

In many of the electrical connectors, a male connector housing and a female connector housing are engaged with each other for electrical connection through terminal members installed therein. If such connectors are to be installed at a place where they are subject to rain water, waterproof electrical connectors are used to prevent short circuiting.

One example of such conventional waterproof electrical connectors is shown in FIG. 1, in which a male connector housing 1 is to be engaged with a female connector housing 2. Around the periphery 1*a* of said male connector housing 1, there is formed an annular enclosure 1*b*. Said annular enclosure 1*b* is formed by an annular wall 3 surrounding said outer periphery 1*a* and an end wall 4 extends radially to connect said annular wall 3 and said outer periphery 1*a* to define an annular cavity 6. On the other hand, the female connector housing 2 includes an outer periphery 2*a* and a sleeve 2*b* extending forwardly of said outer periphery 2*a*.

When a seal ring 7 of resilient material such as rubber is inserted in said cavity 6, said seal ring 7 fits against the annular enclosure to leave a space 6' inwardly thereof. At the same time, said seal ring is formed with an engaging protrusion 7*a* in an outer periphery thereof as shown in FIG. 2, said engaging protrusion 7*a* is squeezed into an engaging window 3*a* formed in the annular wall 3 of the male connector housing 1 for securing said seal ring 7 within said cavity 6.

FIG. 3*a* is a sectional view of the seal ring 7 taken along the line III—III of FIG. 2 to show a seal ring 7*c* which bulges around the inner periphery thereof which press contacts the sleeve 2*b* of the female connector housing 2. In the prior art as described in the foregoing, said seal ring 7 has a tendancy to turn over inside out at the time of engagement or disengagement of both housings as shown in FIG. 3*b*. In this way, the positioning of the seal ring 7 within the cavity will not be assured for making the connector waterproof. In order to overcome the shortcoming of the prior art waterproof connector, it is an object of the present invention to provide a seal ring which will not turn over even at the time of engagement or disengagement of the male and female connector housings.

SUMMARY OF THE INVENTION

Essentially, the above object is realized by providing a waterproof electrical connector comprising: a first connector housing having an annular enclosure formed around an outer periphery thereof, said annular enclosure including an annular wall surrounding said outer periphery of the first connector housing and an end wall extending radially to connect said annular wall and said outer periphery to define a cavity; a seal ring inserted in said cavity, and having a first section of smaller wall thickness to leave a space forwardly opening and a second section of larger wall thickness extending rearwardly of said first section to resiliently press fit said annular enclosure, said end wall and said outer periphery; and a second connector housing having a sleeve formed forwardly of an outer periphery thereof and adapted to be inserted into said space.

DETAILED DESCRIPTION OF THE EMBODIMENTS

Figure 1:
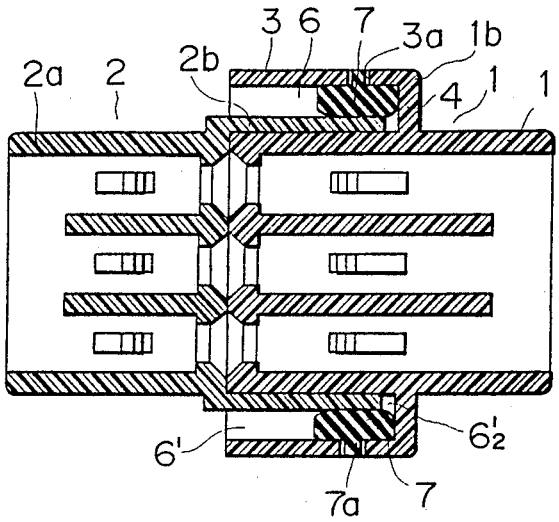
FIG. 1 PRIOR ART
FIG. 1 is a sectional view of the male and female connector housings engaged with each other in the prior art waterproof connector.
Figure 2:
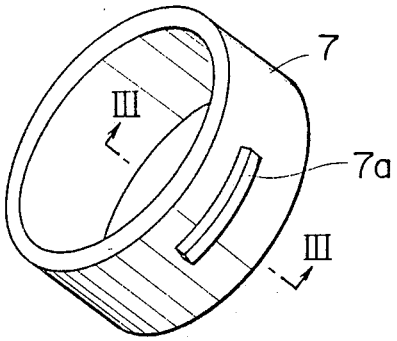
FIG. 2 PRIOR ART
FIG. 2 is a perspective view of the seal ring used in the connector of FIG. 1.
Figure 3A:
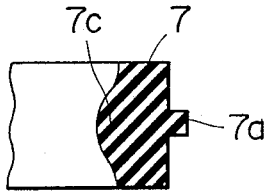
FIG. 3a PRIOR ART
FIG. 3*a* is a partially broken-away view of the seal ring in section along the line III—III of FIG. 2.
Figure 3B:
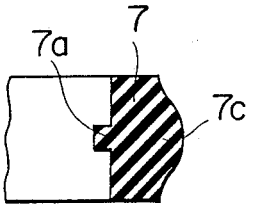
FIG. 3b PRIOR ART
FIG. 3*b* is a similar view of the seal ring which shows a turned over state of the seal ring of FIG. 3*a;*
Figure 4:
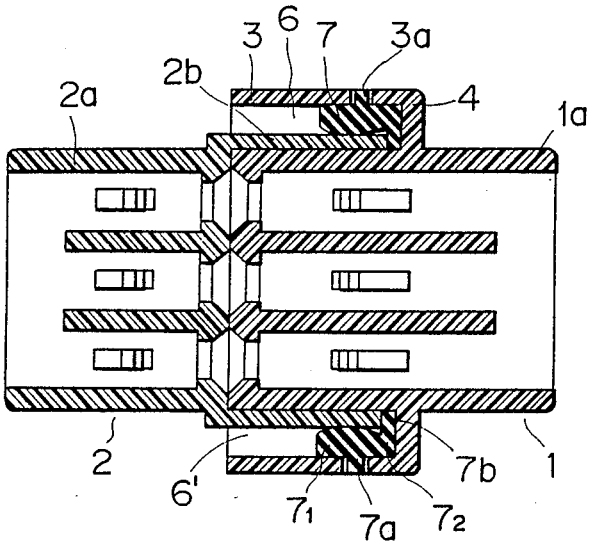
FIG. 4 is a longitudinal sectional view of one embodiment of the present invention.

Referring to FIG. 4, in which one embodiment of the present invention, the male and female connector housings 1 and 2 are engaged. Although not shown, the male connector housing 1 is accommodated with female terminal members and water seal plugs therein whereas the female connector housing is accomodated with male terminal members and water seal plugs. Basically, the structure of the waterproof connector of the invention is similar to that of the prior art connector. For example, there is formed an end wall 4 erecting from around the outer periphery 1*a* of the male connector housing 1 while an annular wall 3 is extending parallelly around the outer periphery 1*a* of the male connector housing 1. Said annular wall 3 and said outer periphery 1*a* is connected by the end wall 4 to define a cavity 6 therebetween.

Figure 6:
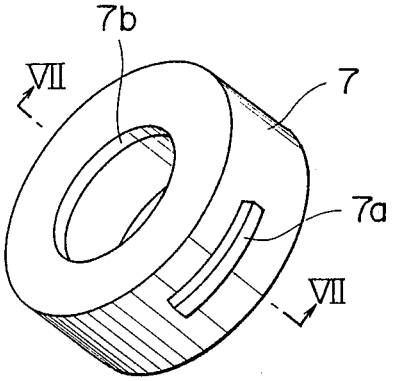
FIG. 6 is a perspective view of the seal ring used in the embodiments of FIG. 4 and FIG. 5.
Figure 7:
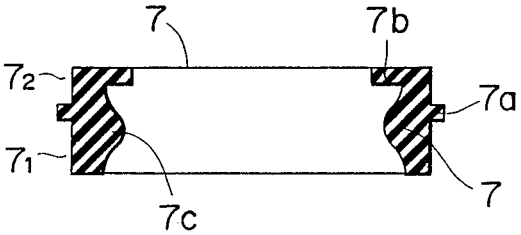
FIG. 7 is a sectional view of the seal ring shown in FIG. 6 taken along the line VII—VII.

Within said cavity 6 a seal ring 7 is inserted. As shown in FIG. 6, said seal ring 7 has a first section $7_1$ of smaller wall thickness to leave, when inserted in the cavity 6, a space 6' forwardly opening and a second section $7_2$ of larger wall thickness extending rearwardly of said first section to resiliently press fit said annular enclosure 3, said end wall 4 and said outer periphery 1*a*. It is particularly important that said second section $7_2$ has a sufficient size to reach the outer periphery 1*a* of the first connector housing. Again, like a prior art connector, said seal ring 7 is formed with a engaging protrusion 7*a* which is squeezed into a window 3*a* in the annular enclosure for positioning said seal ring 7 generally within said space 6.

Figure 5:
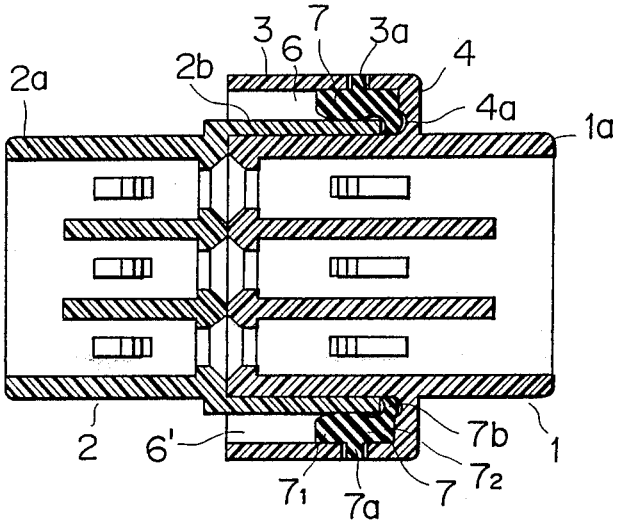
FIG. 5 is a longitudinal sectional view of another embodiment of the present invention.

In the embodiments of FIGS. 4 and 5, said second section 7 takes the form of inwardly extending rib 7*b*.

Said rib $7_2$ serves the purpose of preventing the seal ring 7 from turning over inside out as a result of torsion caused at the time of disengagement by a shearing force by means of the contact surfaces of the seal ring 7 and the annular wall 4. Therefore, the rib may be formed in the outside of the seal ring 7 or in both sides thereof instead of only in the inside thereof as shown in FIGS. 5 and 6. In case where a rib is formed in the outside of seal ring 7, such rib serves to act as an engaging protrusion *7a*.

The rib *7b* is formed between the tip of the sleeve *2b* and the end wall 4. However, the rib *7b* is not required to be compressed for performing sealing action, which is performed by the radial compression of the seal by means of the inner periphery of the annular enclosure and the outer periphery of the sleeve *2b*.

With the seal ring within the cavity 6, both connector housings will be prevented by said rib *7b* from sliding over each other in an engagement direction, male and female terminal members housed in the connector housings are prevented from being worn out through their sliding movements and the resultant poor contact is avoided.

However, if the rib is longitudinally too thick the tip of the sleeve *2b* and end wall 4 must compress the rib requiring a large force at the time of engagement. In order to avoid it, a groove *4a* continuous around the outer periphery of the male connectors formed in the end wall at an innermost end thereof where said end wall 4 contacts the rib *7b* such that the compression force is released at the time of engagement. In other words, when the compression is exerted on the rib *7b*, said rib is deformed in a curved line and received into said groove *4a*, thus facilitating engagement with a reduced force.

Figure 8:
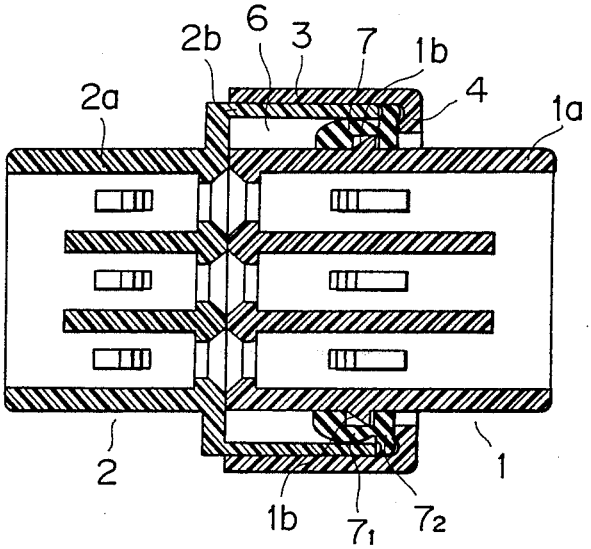
FIG. 8 is a longitudinal sectional view of a further embodiment of the present invention.
Figure 9:
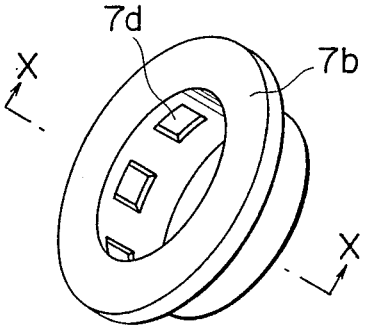
FIG. 9 is a perspective view of the seal ring used in the embodiment of FIG. 8.
Figure 10:
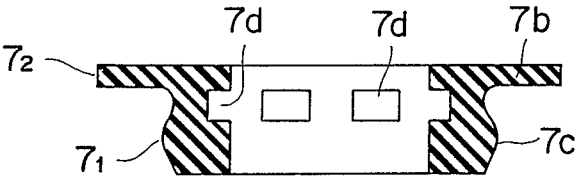
FIG. 10 is a sectional view of the seal ring shown in FIG. 9 taken along the line X—X.

Referring to FIGS. 8 through 10, a further embodiment is shown in which the basic structure is similar to those embodiment in the foregoing except that the sleeve *2b* of the second connector housing 2 is adapted to come into sliding engagement with the interior of the annular wall 3 while the seal ring 7 is inserted within the cavity 6 for the first section $7_1$ thereof to contact the outer periphery *1a* of the first connector housing 1.

Consequently, the second section $7_2$ is provided in the form of outwardly extending rib *7b* as best shown in FIG. 9. Further, the seal positioning provided by the relationship of engaging window *3a* and engaging protrusion *7a* in the prior art and foregoing embodiments is accomplished by provision of a plurality of recesses *7d* circularly formed in the inner side surface of the seal ring 7 and corresponding projections *1b* formed in the outer periphery *1a* of the male connector housing 1 to be received therein.

Throughout the embodiment, it will be understood that the seal ring 7 has a bulge *7c* to secure the seal thereof against the sleeve. To make said bulge *7c* work properly, the recesses *7d* formed in the seal ring 7 is preferably formed in positions staggered from said bulge *7c*.

As explained in the foregoing, the seal ring provided in the engaging portion the connector housings of the present invention is formed with a rib in the outer and/or inner periphery thereof while the end wall of one of the housings is formed with a groove at an innermost end thereof. As a result, the seal ring is resistant to the shearing force due to its larger wall thickness at the time of connector engagement and disengagement to keep from turning over inside out, thus preventing water leakage due to seal dislocation within the cavity. Moreover, the provision of the groove in the end wall has accomplished easy engagement of connector housings without use of large force.

What is claimed is:

1. A waterproof electrical connector comprising a first connector housing having an annular enclosure formed around an outer periphery thereof, said annular enclosure including an annular wall surrounding said outer periphery of the first connector housing and an end wall extending radially to connect said annular wall and said outer periphery to define a cavity;

a groove formed in said end wall of said annular enclosure and facing said cavity;

a seal ring inserted in said cavity, said seal ring being formed of a resilient material and having a first section of smaller wall thickness to provide a forwardly open space in said cavity and a second section of larger wall thickness extending rearwardly of said first section and including an inwardly extending rib, said second section abutting said end wall and being compressed between said annular enclosure and said outer periphery of said first connector housing; and a second connector housing having a sleeve projecting forwardly of an outer periphery thereof and adapted to be inserted into said open space to contact the outer periphery of the first connector housing and radially compress said first section of said seal ring in said cavity with said groove providing space for axial displacement of said inwardly extending rib.

2. A waterproof electrical connector according to claim 1, wherein said groove is a continuous groove around the outer periphery of the first connector.

* * * * *